United States Patent [19]

Stangl

[11] Patent Number: 4,739,908

[45] Date of Patent: Apr. 26, 1988

[54] MANIPULATOR FOR ENGAGING A POURING TUBE WITH A DISCHARGE GATE OF A POURING LADLE

[76] Inventor: Kurt Stangl, A-4844 Regau 106, Austria

[21] Appl. No.: 49,923

[22] Filed: May 15, 1987

[30] Foreign Application Priority Data

Jun. 3, 1986 [AT] Austria ..... 1484/86

[51] Int. Cl.[4] ..... B22D 37/00; B25J 11/00

[52] U.S. Cl. ..... 222/607; 901/22; 901/15; 91/178; 164/337

[58] Field of Search ..... 222/606, 607, 591; 901/15, 22; 414/733; 164/337, 437; 91/171, 178

[56] References Cited

U.S. PATENT DOCUMENTS

| | | | |
|---|---|---|---|
| 3,637,092 | 1/1972 | George et al. | 901/22 X |
| 3,792,782 | 2/1974 | Melton | 901/15 X |
| 3,921,730 | 11/1975 | Farre et al. | 414/733 X |
| 4,316,561 | 2/1982 | Grosko | 222/607 X |
| 4,381,102 | 4/1983 | King | 222/607 X |
| 4,550,867 | 11/1985 | Bell et al. | 222/607 |
| 4,643,339 | 2/1987 | Petracchi | 222/607 |

FOREIGN PATENT DOCUMENTS

| | | | |
|---|---|---|---|
| 360188 | 12/1980 | Austria . | |
| 364103 | 2/1981 | Austria . | |
| EPA0160593 | 11/1985 | European Pat. Off. . | |
| 645921 | 2/1979 | U.S.S.R. | 901/22 |
| 837846 | 6/1981 | U.S.S.R. | 901/15 |

*Primary Examiner*—Joseph J. Rolla
*Assistant Examiner*—Nils Pedersen
*Attorney, Agent, or Firm*—Kurt Kelman

[57] ABSTRACT

A manipulator for engaging a pouring tube (11) with a discharge gate of a pouring ladle comprises a post (3) and a boom (4), which is adjustably mounted on the post (3) and adapted to carry the pouring tube (11). To provide for a simple sequence of movements and a simple control, the post (3) is pivoted to a base (1) on a horizontal axis (2), the boom (4) is pivoted to the post (3) on an axis (5), which is parallel to the pivotal axis of the post (3), and the post (3) and the boom (4) are pivotally movable about their respective pivotal axes by respective torque cylinders (6).

5 Claims, 1 Drawing Sheet

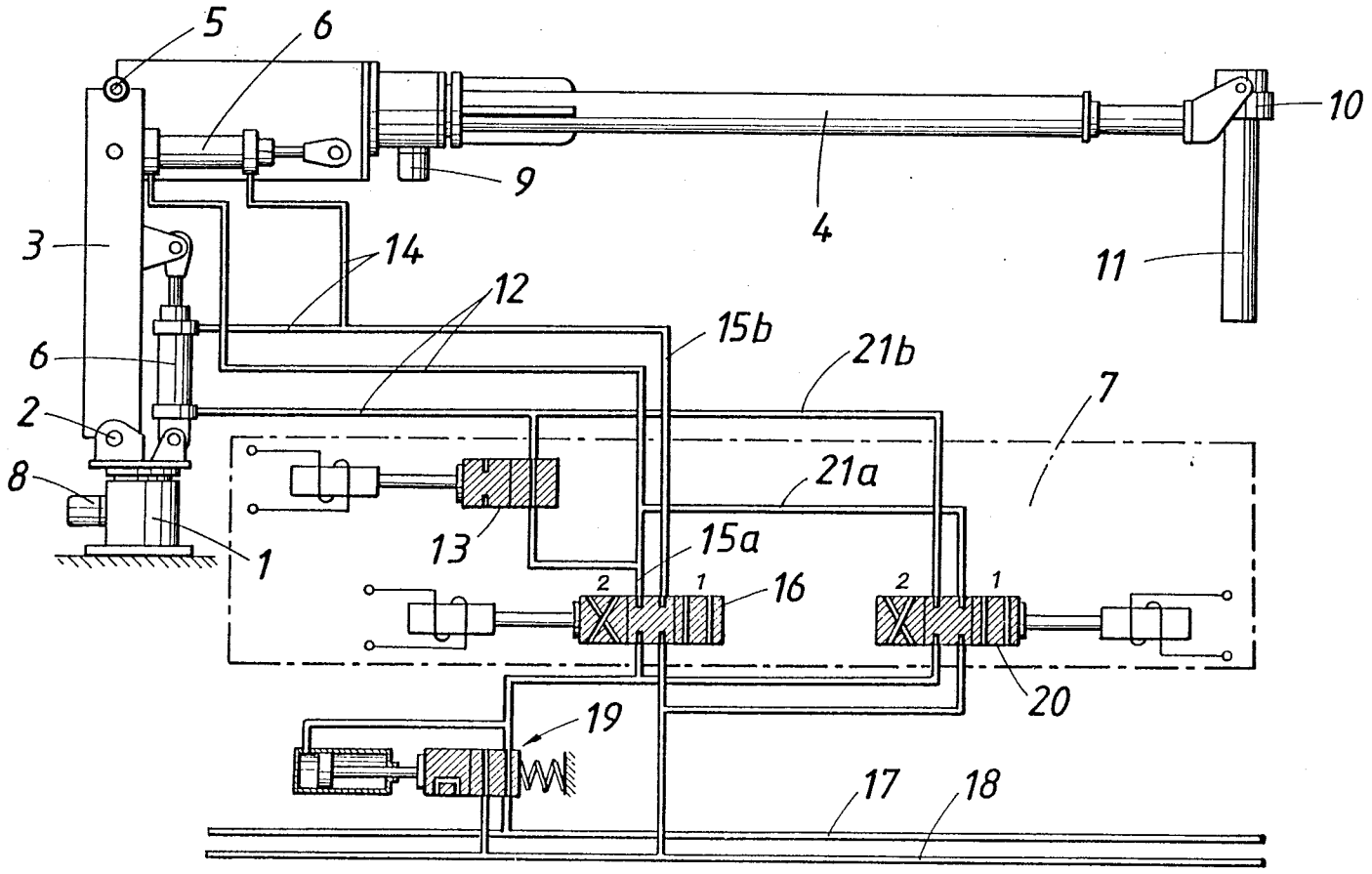
10
11
7
20
18
17
21b
21a
4
16
15b
15a
19
9
12
13
14
6
1
5
3
6
2
8

MANIPULATOR FOR ENGAGING A POURING TUBE WITH A DISCHARGE GATE OF A POURING LADLE

BACKGROUND OF THE INVENTION

1. Field of the Invention

This invention relates to a manipulator for engaging a pouring tube with the discharge gate of a pouring ladle, which manipulator comprises a post and a boom, which is adjustably mounted on the post and is operable to force the pouring tube against the discharge gate and is pivotally movable about two axes, which are at right angles to each other.

2. Description of the prior Art

For a central of the flow of molten steel out of a pouring ladle into a succeeding distributor, a pouring tube is forced against the bottom outlet of the pouring ladle and is used to conduct the molten steel from the pouring ladle into the distributor. By means of a manipulator that pouring tube is engaged with a mating centering extension provided on the discharge gate of the pouring ladle and to open the discharge gate valve is moved in unison with that gate into alignment with the bottom outlet of the ladle. For that purpose the manipulator must be movable in unison with the discharge gate and with the pouring ladle while the required pressure is applied. From EP-A-0 160 593 it is known for that purpose to mount the pouring tube on a boom, which is movably mounted on a slide, which is displaceable along a past and operatively connected to a drive so that the pouring tube can be forced against the discharge gate under the required pressure by the drive via the slide regardless of movements of the boom which are transverse to the post. Such transverse movements can be performed by the boom because it is linked to the slide by means of a link, which is pivoted on a vertical axis. That known design has the disadvantage that the boom exerts a substantial torque on the slide so that the latter tends to be canted within its track. A canting of the slide in the associated track will adversely affect the transmission of force by the slide from the associated drive to the pouring tube and will prevent the application of a constant pressure for urging the pouring tube against the discharge gate.

Similar disadvantages are involved in another design, which is known from Austrian Patent Specification No. 360,188 and in which the post carrying the boom is mounted in a sleeve to be axially displaceable and rotatable relative thereto and is acted upon in an axial direction by a cylinder. In that case too, a torque is exerted on the post by the boom so that the post may be constrained in the associated bearing sleeve.

If the boom is pivoted on a horizontal axis, specifically on a vertical shaft that is mounted on the pouring ladle, so that the pouring tube can be adjusted in height, a transmission of torque from the boom to the vertical shaft can be avoided because the boom is pivotally movable. But in that case the boom can perform only an angular movement in a horizontal direction. This will be tolerable if the boom is mounted directly on the pouring ladle but will be intolerable if the boom is mounted on a manipulator, which is mounted separately of the pouring ladle.

From Austrian Patent Specification No. 364,103 it is also known that an additional degree of freedom can be provided for the movement of the pouring tube by means of a boom which is pivoted on a horizontal axis to a post that is rotatable about a vertical axis. This is accomplished in that the boom consists of two parts, which are hingedly connected on a vertical axis. But that design has also the disadvantage that the force by which the pouring tube is forced against the discharge gate causes the hinge between the two parts of the boom to be subjected to a torque about a transverse axis and that the provision of boom consisting of two hinged parts adds to the structural expenditure. Besides, the pouring tube can be adjusted only by hand.

SUMMARY OF THE INVENTION

It is an object of the invention to avoid the disadvantages outlined hereinbefore and so to improve a manipulator which is of the kind described first hereinbefore that a manual actuation of the boom will be avoided and the pouring tube will be forced against the discharge gate of the pouring ladle by a predetermined force whereas the horizontal movement imparted to the pouring tube by the discharge gate will not be hindered. This is to be accomplished by the use of simple means.

The object set forth is accomplished in accordance with the invention in that the post is pivoted on a horizontal axis to a base that is rotatable about a vertical axis, the boom is pivoted to the post on an axis that is parallel to the pivotal axis of the post, two torque cylinders are associated with the post and the boom, respectively, and are operable to exert equal torques on the post and the boom in a sense to force the pouring tube against the discharge gate, the two torque cylinders are adapted to be supplied with pressure fluid from either end under the control of a control system, and when torques are exerted on the post and on the boom in a sense to force the pouring tube against the discharge gate the two torque cylinders are interconnected at their pressurized ends by transfer line.

Because the boom is pivoted to the post and the post is pivoted to the base about parallel horizontal axes a canting or a transverse loading of a track will be avoided so that the transmission of force to the boom will not be adversely affected by such canting or transverse loading. This result is obtained because the pivotal mountings of the post and the boom need not take up any torque. Torque is taken up only by the two torque cylinders, which are also used to exert the forces by which the pouring tube is forced against the discharge gate of the pouring ladle. The pivotal mountings of the post and of the boom also permit a movement of the pouring tube in vertical and horizontal directions and together with the rotatable mounting of the base permit of movements along three coordinates axes.

When the pouring tube is forced against the discharge gate of the pouring ladle, the torques exerted by the two torque cylinders being operated are accumulated and it must be ensured that neither of said torques is so much in excess of the other that the post and the associated torque cylinder can rotate relative to each other, because a rotation of the post and of the associated torque cylinder will inevitably result in a displacement of the pouring tube. For this reason the torques exerted on the post and on the boom by the two torque cylinders must be equal as long as the pouring tube is to be forced against the discharge gate.

To maintain the freedom of movement in a direction that is transverse to the direction in which the pouring tube is forced against the discharge by a predetermined constant force, the two torque cylinders are interconnected at their pressurized ends by transfer line so that the pistons of the torque cylinders can be displaced in response to a displacement of the pouring tube and a compensation can be effected in that case by a flow of fluid between the cylinders. The force required for this purpose is relatively small because it is sufficient to overcome the resistances to the flow of the fluid and the frictional resitances of the pistons.

In spite of said transfer line the two torque cylinders should be operable independently from each other or in mutually opposite senses, as may be required, e.g., to move the pouring tube to a desired position. This may be accomplished within the scope of the invention in that a shut-off valve is incorporated in the transfer line so that the two torque cylinders can be operated entirely independently of each other when the transfer line is shut off.

If the two torque cylinders are interconnected by a communicating line on that side of the piston which is opposite to the transfer line, the free displacement of the torque cylinders in mutually opposite directions will be facilitated when the torque cylinders are operated in a sense to force the pouring tube against the discharge gate and the two torque cylinders can be controlled in a simple manner for an operation in the same sense to raise or lower the pouring tube. In that case it will be sufficient to provide each of the transfer and communicating lines between the two torque cylinders with a connecting line that incorporates a shut-off valve and to selectively connect the transfer and communicating lines via the connecting line to a pressure fluid line and return line in alternation under the control of the control system acting on the shut-off valves. When the connecting line associated with the communicating line or with the transfer line is connected to the pressure fluid line, the two torque cylinders will be operated to lower or raise the pouring tube, respectively.

Because the two torque cylinders are interconnected at one end by a transfer line and at the other end by a communicating line, the cylinders can be operated in mutually opposite senses under the control of a relatively simple control system because the fluid leaving one cylinder being operated can be supplied to the other torque cylinder. For that purpose two pressure lines may be connected to the transfer line on both sides of the shut-off valve therein and said pressure lines may selectively be connected by the control system to the pressure fluid line and to the return line in alternation. When the shut-off valve is closed in such an arrangement, the two pressure lines may be used to selectively supply pressure fluid to one of the two torque cylinders and to deliver the pressure fluid leaving that torque cylinder to the other torque cylinder so that the torque cylinders will be operated in mutually opposite senses. For that mode of operation the shut-off valve in the connecting line associated with the communicating line must be closed to prevent a flow of fluid from the communicating line. The fluid leaving that torque cylinder which is supplied with fluid from the torque cylinder that is supplied with fluid from the pressure fluid line can be drained through the pressure line that is connected to the transfer line between that torque cylinder and the shut-off valve because that pressure line is connected to the return line during that mode of operation.

BRIEF DESCRIPTION OF THE DRAWING

The drawing is a diagrammatic block circuit diagram illustrating a manipulator which emboides the invention and is used to engage a pouring tube with the discharge gate of a pouring ladle.

DETAILED DESCRIPTION OF THE PREFERRED EMBODIMENT

The invention will now be described by way of example with reference to the drawing.

The illustrated manipulator substantially consist of a post 3, which is pivoted to a base 1 on a horizontal axis 2. A boom 4 is pivoted to the post 3 on an axis 5 which is parallel to the pivotal axis 2 of the post 3. Two torque cylinders 6 are associated with the post 3 and the boom 4, respectively, and serve to move the post 3 relative to the base about the axis 2 and to move the boom 2 relative to the post 3 about the axis 5. The operation of the two torque cylinders 6 is controlled by a control system 7.

The post 3 which carries the boom 4 can be rotated on a vertical axis in unison with the base 1. For that purpose the base 1 is rotatably mounted and provided with a rotary drive 8. In addition, the boom 4 can be rotated about its longitudinal axis by a rotary drive 9. As a result, the pouring tube 11, which is held in a mounting ring 10 carried by the boom 4, can be moved along three coordinate axes and can additionally be rotated about the axis of the boom.

When torques are exerted by the two torque cylinders 6 on the post 3 and the boom 4 in a sense to force the pouring tube 11 against a discharge gate of a pouring ladle, not shown, the two torque cylinders 6 are interconnected by a transfer line 12 at those ends to which pressure fluid is supplied. The transfer line incorporates a shut-off valve 13 for shutting off the line 12. On that side of the pistons in the torque cylinder 6 which is opposite to the transfer line 12, the torque cylinders 6 are interconnected by a communicating line 14. The transfer line 12 and the communicating line are connected to a directional valve 16 by respective connecting lines **15*a* and 15*b*. The directional valve 16 selectively shuts off the connecting lines or connects them to a pressure fluid line 17 and a fluid return line 18, respectively. A pressure-limiting valve 19** for setting a certain pressure applied is interposed.

In addition to the directional valve 16, the control system 7 comprises a directional valve 20, which is connected to the pressure fluid line 17 and the return line 18 in parallel. By two pressure lines **21*a* and 21*b* connected to the transfer line 12 on opposite sides of the shut-off valve, the directional valve 20 is connected to the transfer line 12 between the two torque cylinders. By means of the directional valve 20, the pressure lines 21*a*, 21*b* are selectively shut off or are connected to the pressure fluid line 17** and the return line in alternation.

For a pouring operation the pouring tube 11 is to be forced against the discharge gate of the pouring ladle. For that purpose the directional valve 16 must be moved from its shut-off position shown on the drawing to the position designated 1, in which pressure fluid from the pressure fluid line 17 can flow through one connecting line **15*a* to the transfer line 12 and can operate the two torque cylinders 6 in a sense to force the pouring tube 11 against the discharge gate. To ensure that this will not result in a displacement of the pouring tube in a direction which is transverse to the direction in which pressure is applied by the pouring tube, the torques exerted by the two torque cylinders 6 must be equal. When the pouring tube 11 is held in position, the torque acting between the post 3 and the boom 4 opposes the torque that is exerted on the post 3 by the torque cylinder 6 that is supported on the base. Said two torques must then be equal if a displacement of the pouring tube 11 by the torque cylinders 6** in a direction that is transverse to the direction of the pressure applied is to be prevented.

In spite of the supply of pressure fluid to both torque cylinders 6, the freedom of movement of the pouring tube 11 in response to an externally applied force, e.g., to a movement of the discharge gate, will be preserved because the pistons in the torque cylinders 6 remain freely displaceable. During a movement of the boom 4 by an external force, fluid can be transferred in the lines 12 and 14 which are connected the torque cylinders 6 at opposite ends so that the pistons of the torque cylinder 6 can be displaced.

If the pouring tube 11 is to be moved to a defined position before it is forced against the discharge gate, it will be necessary to impart forward or rearward or raising or lowering movements to the boom. The control will be particularly simple when the pouring tube 11 is to be raised because in that case the torque cylinders 6 must be operated in the sense to force the pouring tube 11 against the discharge gate. For that purpose the directional valve 16 is moved to the control position 1. The fluid leaving the torque cylinders flows through the communicating line 14 and the associated connecting line **15*b* to the directional valve 16 and from the latter to the return line 18 for the fluid. For a lowering of the pouring tube 11, the torque cylinders 6 must be operated in the opposite sense. For that purpose the directional valve 16 must be moved to position 2 to connect the communicating line 14 by the associated connecting line 15*b* to the pressure fluid line 17 and the fluid is returned through the transfer line 12 and the associated connecting line 15*a***.

For a forward movement of the boom 4, the two torque cylinders 6 must be operated in mutually opposite senses. For that purpose the shut-off valve in the transfer line 12 must be closed to shut off the line 12. When the shut-off valve 13 is closed, that part of the transfer line 12 which communicates with the torque cylinder 6 associated with the boom 4 can be connected to the pressure fluid line 17 by the directional valve 20, which for that purpose must be moved to the control position designated 2. Because the pressure line **15*b* is shut off by the directional valve 16, the fluid flowing through the communicating line 14 out of the torque cylinder 6 associated with the boom 4 cannot flow into the return line 18 but will be supplied to the torque cylinder 6 associated with the post 3 so that the latter torque cylinder 6 will move oppositely to the other torque cylinder 6. The fluid which is displaced out of said torque cylinder which is associated with the boom 4 can return to the pressure line 21*b*. When it is desired to impart a rearward movement to the boom 4, the directional valve 20 is moved to its position 1, in which the pressure line 21*b* is connected to the pressure fluid line 17 and the pressure line 21*a* is connected to the return line 18 for the fluid. In that case the fluid leaving the torque cylinder 6 associated with the post 3 is supplied via the communicating line 14 to the torque cylinder 6 associated with the boom and the fluid leaving the latter torque cylinder can be drained through one part of the transfer line 12 and the associated pressure line 21*a***.

When it is desired to hold the pouring tube in a predetermined position the directional valves 16 and 20 and the shut-off valve 13 must be closed to that the otherwise existing freedom of displacement of the two pistons in the torque cylinders 6 is eliminated.

It is apparent that the pouring tube can be moved as desired and can be forced against the discharge gate of a pouring ladle under the control of the control system 7. It will be understood that the control system 7 has been only diagrammatically shown and may be modified in various ways because it is sufficient that to provide certain selectable flow paths regardless of the elements which are movable to establish said flow paths.

It will be understood that the manipulator is operable to force the pouring to 11 against the discharge gate of the pouring ladle in such a manner that the pouring tube 11 applies an endwise pressure in a predetermined direction against said discharge gate.

I claim:

1. In a manipulator for causing a pouring tube to apply an endwise pressure in a predetermined direction, which manipulator comprises a post; and a boom, which is adapted to carry said pouring tube and is movably mounted on said post and is pivotally movable in two planes, which are at right angles to each other, the improvement residing in that said manipulator comprises a base, said post is pivoted to said base on a first horizontal pivotal axis, said boom is pivoted to said post on a second pivotal axis, which is parallel to and spaced from said first axis, said manipulator further comprises two torque cylinders, which are respectively associated with and operable to exert torques on said post and said boom about said first and second pivotal axes, respectively, and a control system for selectively supplying pressure fluid to a first end of each of said torque cylinders in a first mode of operation and to a second end of each of said torque cylinders in a second mode of operation, said torque cylinders being arranged to exert equal torques on said post and on said boom to cause an endwise pressure to be applied by said pouring tube in said predetermined direction in response to a supply of pressure fluid from said control system to each of said torque cylinders at said first end thereof, and said two torque cylinders are interconnected at said first end thereof by a transfer line.

2. The improvement set forth in claim 1, wherein a shut-off valve is incorporated in said transfer line.

3. The improvement set forth in claim 1, wherein a piston is disposed in each of said torque cylinders between said first and second ends and said two torque cylinders are interconnected by a communicating line on that side of said piston in each of said cylinders which is opposite to said first end.

4. The improvement set forth in claim 3, wherein said control system comprises a pressure fluid line, a return line, first and second connecting lines, which are connected to said transfer lines and said communicating line, respectively, and incorporate a shut-off valve each, and valve means for selectively connecting said first and second connecting lines to said pressure fluid line and said return line in alternation.

5. The improvement set forth in claim 2, wherein said transfer line has first and second portions on opposite sides of said shut-off valve, first and second pressure lines are respectively connected to said first and second portions of said transfer line and said control system comprises a pressure fluid line, a return line and valve means for selectively connecting said first and second pressure lines, respectively, to said pressure fluid line and said return line alternatively.

* * * * *